United States Patent [19]

Baker et al.

[11] Patent Number: 4,754,442

[45] Date of Patent: Jun. 28, 1988

[54] VARIABLE DEPTH SONAR LINE HANDLING SYSTEM

[75] Inventors: Henry O. Baker, Ottawa; Robert S. Norminton, Niagara Falls, both of Canada

[73] Assignee: Her Majesty the Queen in right of Canada, as represented by the Minister of National Defence, Canada

[21] Appl. No.: 16,119

[22] Filed: Feb. 18, 1987

[30] Foreign Application Priority Data

May 27, 1986 [CA] Canada ..... 510128

[51] Int. Cl.[4] ..... G01S 9/68; B63B 21/66

[52] U.S. Cl. ..... 367/191; 367/106; 114/254; 114/268; 405/154; 254/264

[58] Field of Search ..... 367/15, 16, 17, 18, 367/19, 20, 106, 130, 140, 141, 153, 154, 169, 191; 181/101, 110, 111, 112, 113, 114, 124, 140; 114/242, 249, 250, 253, 254, 268, 269, 270; 405/158, 166, 180, 181, 201, 168; 254/134.3 SC, 264, 266, 279, 323

[56] References Cited

U.S. PATENT DOCUMENTS

| | | | |
|---|---|---|---|
| 2,180,354 | 11/1939 | Frazier | 367/130 X |
| 3,401,660 | 9/1968 | Strange et al. | 114/270 |
| 3,966,171 | 6/1976 | Hale | 114/254 X |
| 4,080,920 | 3/1978 | Berthet et al. | 114/254 X |
| 4,170,187 | 10/1979 | Schirtzinger | 114/270 X |
| 4,455,961 | 6/1984 | Hansen et al. | 114/254 |
| 4,480,574 | 11/1984 | Bertrams | 114/242 |
| 4,597,352 | 7/1986 | Nominton | 114/254 |

FOREIGN PATENT DOCUMENTS

| | | | |
|---|---|---|---|
| 992949 | 1/1976 | Canada | 114/253 |
| 1111829 | 1/1977 | Canada . | |
| 2405181 | 6/1979 | France | 114/249 |
| 7806357 | 12/1979 | Netherlands | 114/254 |
| 906782 | 2/1982 | U.S.S.R. | 114/242 |

*Primary Examiner*—Deborah L. Kyle
*Assistant Examiner*—Brian S. Steinberger
*Attorney, Agent, or Firm*—Larson and Taylor

[57] ABSTRACT

A variable depth towed sonar line handling system is arranged to provide a level wind of the sonar cable onto a cable winding drum without significant lateral deflection of the cable. The system includes a boom with sheaves at the inboard and outboard ends and an inboard winch with a cable winding drum. The winch is mounted for axial movement past the boom and is translated axially in synchronism with its rotation so that the fleet angle of the cable remains constant. In preferred embodiments, the winch is located beside the boom and translates fore and aft. This allows the cable to be taken off along the pivot axis of the boom, eliminating cable excursion through the sheaves in boom bobbing. Other features include a fairleading saddle and a combined passive and active shock absorbing system.

13 Claims, 9 Drawing Sheets

VARIABLE DEPTH SONAR LINE HANDLING SYSTEM

FIELD OF THE INVENTION

The present invention relates to variable depth towed sonar systems and particularly to line handling in such systems.

BACKGROUND

A conventional variable depth sonar system includes a boom with a sheave at the outboard end, and frequently another sheave in proximity to the inboard end; an inboard winch with a cable winding drum, a cable running over the sheaves from the cable winding drum to a towed body and means for pivoting the boom to attenuate large variations in cable tension during towing in high Sea States. In a system of this sort, complications and difficulties arise in reeling and unreeling the cable on the drum during hauling in and paying out as a result of lateral deflections of cable between the inboard sheave and drum. Additionally, where the boom is caused to "BOB", that is to pivot to attenuate variations in tension on the cable, the cable runs over the sheaves, producing fatigue in the cable that can result in it parting.

To solve these problems, it has been proposed to arrange the winding drum beside the boom rather than behind it, to use an inboard sheave arranged to lead the cable to the drum along the pivot axis of the boom, and to shift the boom along the drum during paying out and reeling in. This arrangement ensures that the cable is wound without deflection onto the drum. It also ensures that during boom bobbing, there is no cable excursion through the sheaves. However, shifting the boom along the drum during paying out or reeling in of the cable requires a large amount of space onboard the ship and a rather complex system for achieving the necessary movement while ensuring the continued functioning of all active parts of the boom.

SUMMARY

The present invention proposes an alternative arrangement for alleviating the cable stresses.

According to the present invention there is provided a variable depth sonar line handling system comprising a boom with sheaves at inboard and outboard ends thereof, an inboard winch with a cable winding drum, a cable running over the sheaves from the cable winding drum of the winch to a towed body, characterized by:

means mounting the winch for movement relative to the boom, in the direction of the axis of the drum; and means for simultaneously rotating the drum and moving the winch axially so as to reel in or pay out the cable.

The shifting winch provides a level wind of the cable onto the drum without a lateral deflection in the cable. It also enables the use of a relatively compact and simple displacement system. An additional benefit of this arrangement is the ability to enclose the drum in a closed housing to protect it from the corrosive salt water environment.

In preferred embodiments of the invention, the winch is located beside the boom and the inboard sheave on the boom is arranged to lead the cable from the boom along the boom pivot axis to the drum. As with the earlier proposal, this means that there is no cable excursion through the sheaves during boom bobbing, thus eliminating a cause of cable fatigue.

BRIEF DESCRIPTION OF THE DRAWINGS

In the accompanying drawings, which illustrate an exemplary embodiment of the present invention.

DETAILED DESCRIPTION

Figure 1:
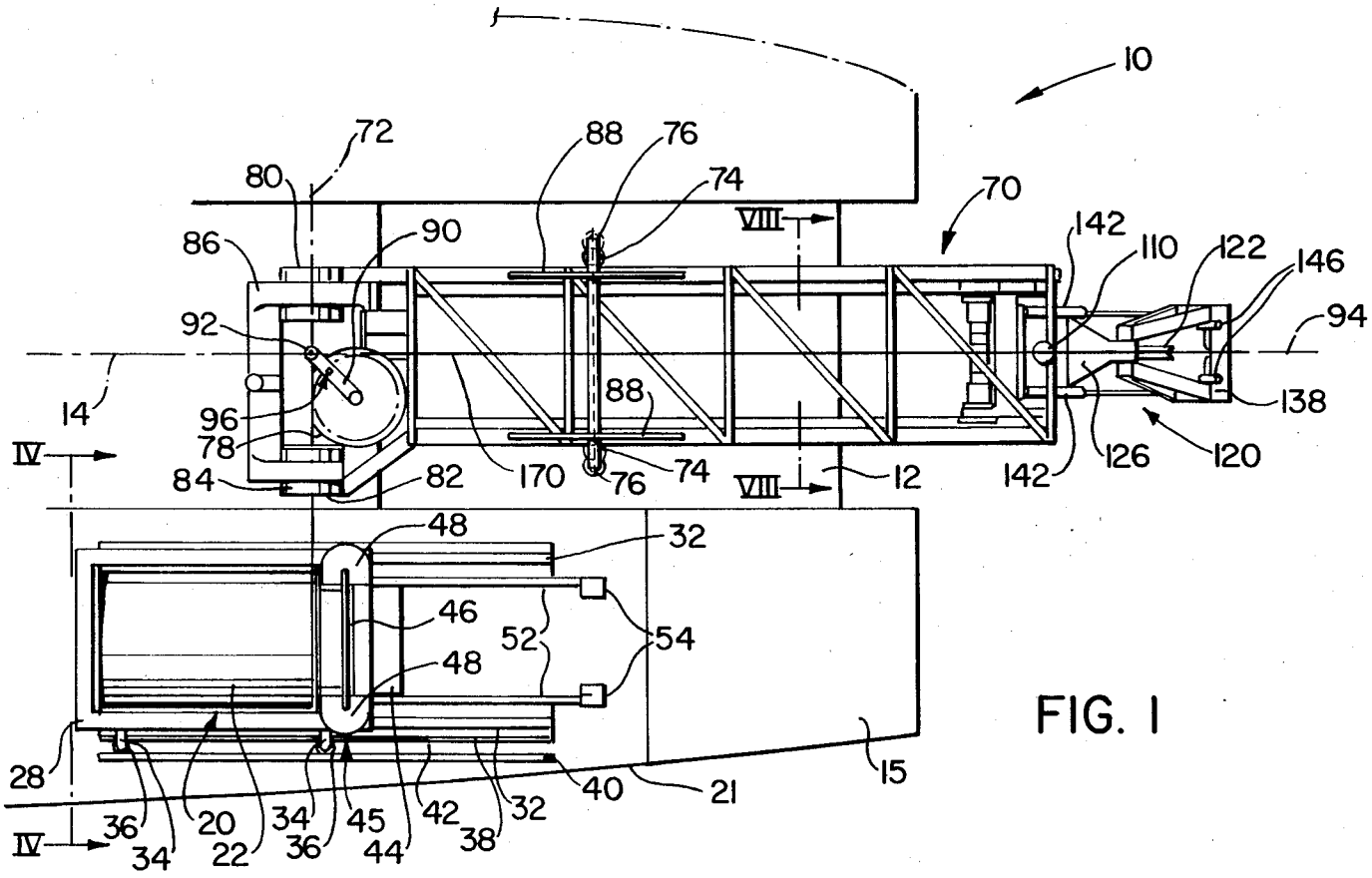
FIG. 1 is a plan view showing a line handling system according to the present invention.
Figure 2:
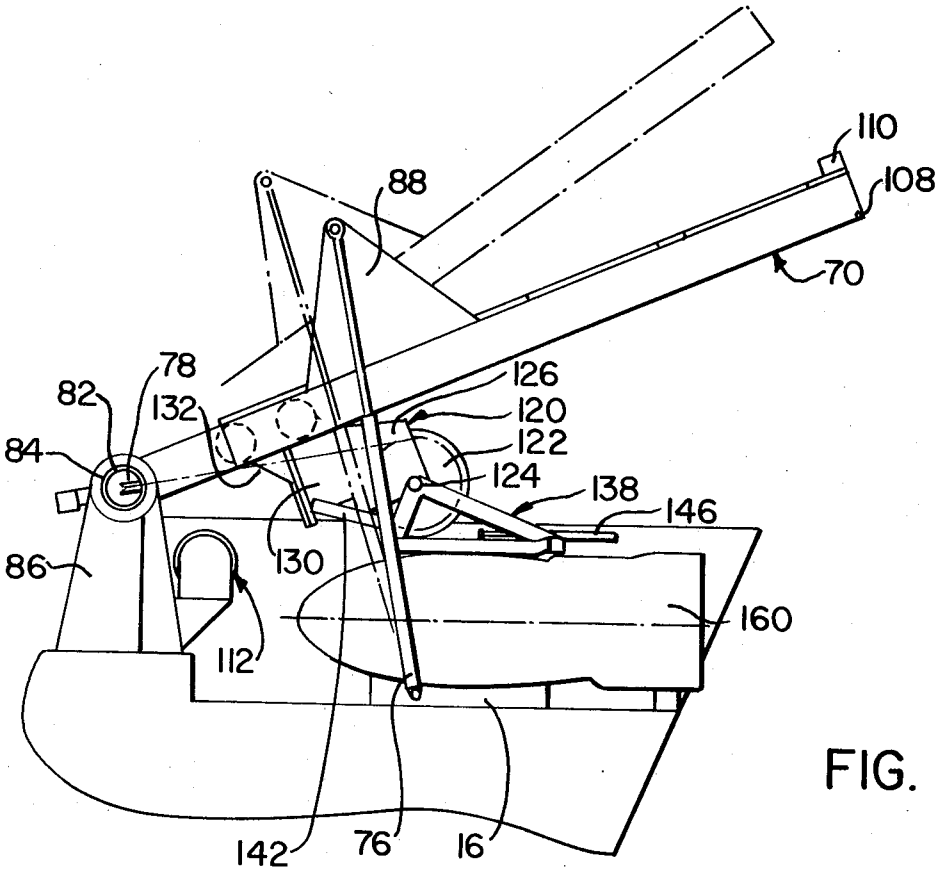
FIG. 2 is a side elevation of the boom showing the boom and body in a stowed condition.
Figure 3:
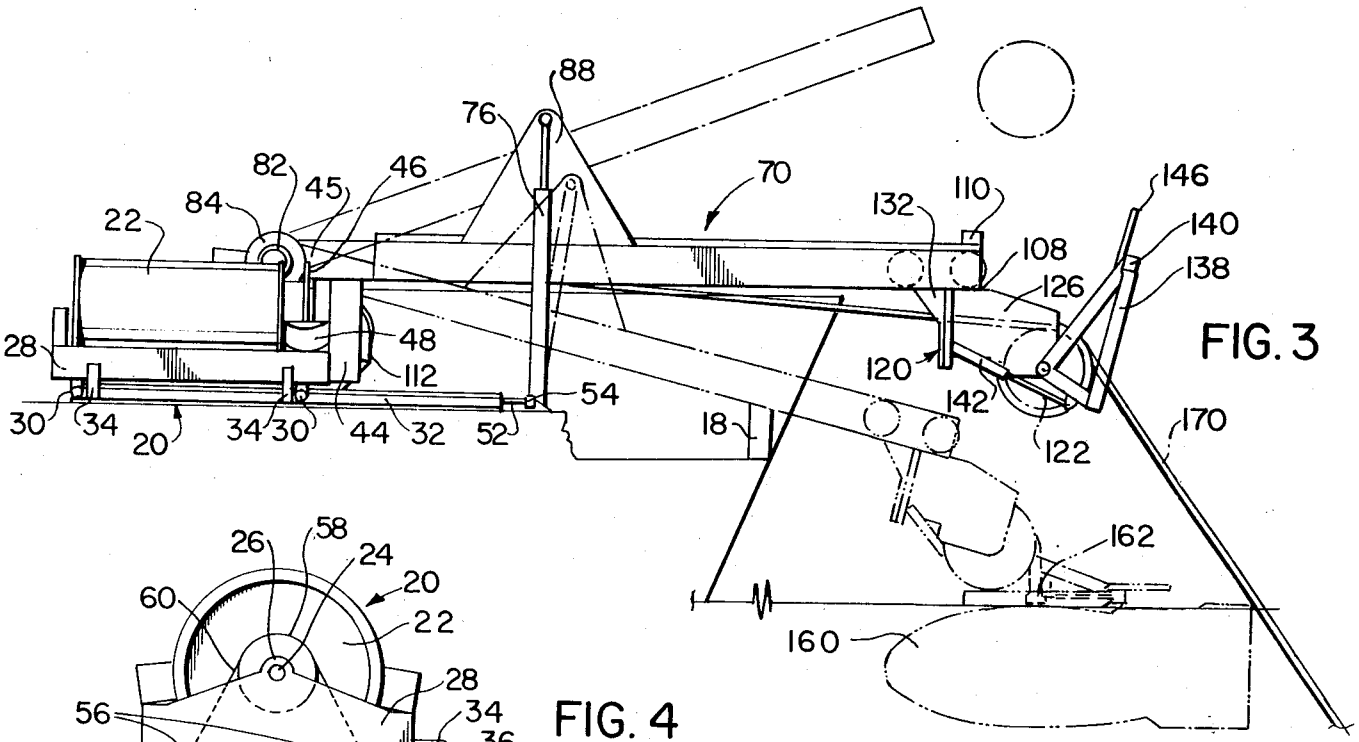
FIG. 3 is a side elevation of the system showing the launch and operating positions of the boom and the fairlead, sheave and saddle assembly.
Figure 4:
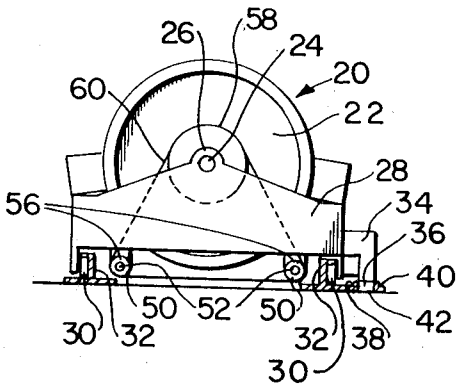
FIG. 4 is a view of the winch along lines IV—IV of FIG. 1.

Referring to the drawings, and most particularly to FIGS. 1, 2 and 3, there is illustrated a variable depth sonar system carried on board ship that is partially illustrated at 10.

The stern of the ship is equipped with a well 12 symmetrically arranged with respect to the ship's center line 14. The well accommodates certain of the system components as will be described in the following.

A winch 20 is mounted on the ship's deck in a compartment 21 forward of a sonar operator's compartment 15. In the illustrated embodiment, the winch and sonar operator's compartment are on the port side of the ship. This arrangement can be reversed with the winch mounted on the starboard side, if desired. The winch has a drum 22 mounted on a drum shaft 24 and supported in bearings 26 mounted on a winch base 28. The winch base is in turn mounted on vertical rollers 30 (i.e. with horizontal axes) that run in tracks 32. On the port side of the winch base are two L-shaped brackets 34 that carry horizontal rollers 36. The horizontal rollers engage, on the inside, a flange 38 on the adjacent track 32 and, on the outside, the vertical flange of an angle 40. The rollers 36 thus run in a track 42 between the flange 38 and the angle 40 to prevent the winch from being pulled off its mountings by cable tension.

The winch is driven by single, direct-drive slow speed motor 44. Its rotation is, when necessary, retarded or stopped by a brake 45 consisting of brake disc 46 and twin calipers 48.

The winch is driven fore and aft along its rails by chain driven nuts 50 running on stationary lead screws 52. The nuts are mounted on the winch base 28 with appropriate bearings. The lead screws 52 are mounted beneath the winch base in supports 54 secured to the deck of the winch compartment. Each nut carries a nut sprocket 56, while a shaft sprocket 58 is secured to the winch shaft. A chain 60 is entrained about the three sprockets to ensure synchronized translation and rotation of the winch. The fixed ratio of rotation to axial displacement is such that the cable runs onto and off of the drum at a fixed position in relation to the ship, and the boom which will be described in the following.

The boom 70 is most clearly illustrated in FIGS. 1, 2, 3 and 8. It is mounted on the ship's centerline 14 and pivots about a transverse axis 72 at its inner end. The pivotal mounting includes two stub shafts 80 and 82 mounted in low friction bearings 84. Port side stub shaft 82, adjacent winch 20, is hollow, while stub shaft 80 may be either hollow or solid. The bearings are mounted in a boom support 86 secured to the ships deck. The boom is also supported by two pairs of hydraulic cylinder 74 and 76 with their cylinders ends connected to the deck and their rod ends attached to projections 88 above the boom, located partway out the span from the pivot axis 72. The cylinders are arranged with one cylinder 74 and one cylinder 76 on each side of the boom. The cylinders are oriented to give as nearly as possible a linear change in pressure with change of cable tension under commonly encountered long term towing conditions. As illustrated in FIG. 3, the cylinders are generally perpendicular to the boom at the midpoint of the bobbing range.

An inboard sheave 78 is mounted on tension links 90 to which are in turn pinned the inner end of the boom to swing about an axis intersecting the pivot axis 72 of the boom and the centreline 94 of the boom. The pivot axis 72 and the centreline 94 of the boom are tangent to the pitch radius of the sheave. Strain gauges 96 are attached to the tension 90 to monitor cable tension.

A tow cable 170 runs from the winch drum 22, along axis 72 through the hollow stub shaft 82. The cable wraps around 90° of the sheave 78 and then runs along the boom centreline 94 to the outer end of the boom. Since the angle of wrap of the cable is always 90°, the strain in the links 90 measured by the strain gauges is always that produced by 1.414 times the cable tension regardless of boom angle or cable trail angle into the sea.

As will be understood from the geometry of the system as thus far desribed, the cable, extending along the pivot axis of the boom, will run onto and off of the translating winch drum at a constant fleet angle. Thus there is no detrimental deflection of the cable.

Figure 8:
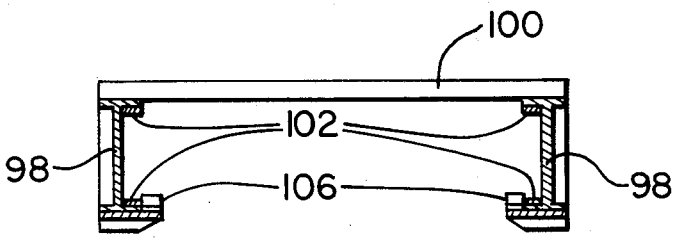
FIG. 8 is a sectional view of the boom along line VIII—VIII of FIG. 1.

FIG. 8 illustrates a section through the boom. The boom has two spaced apart I-beams 98 joined by truss cross bracing 100. On the inside of each beam flange is a hardened tread liner 102. Two racks 106 extend along the inside of the two lower tread liners.

The boom tip is equipped with stops 108 for limiting the outwards movement of a saddle assembly, as will be described in the following. An accelerometer 110 is mounted on the boom tip.

Figure 5:
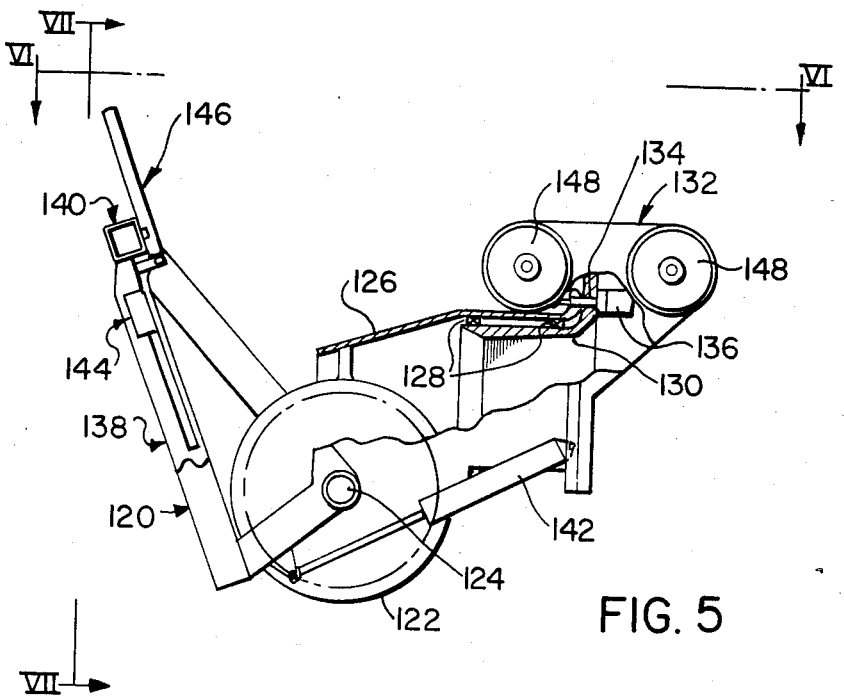
FIG. 5 is a side elevation, partially broken away, of the travelling fairlead, sheave and saddle assembly.
Figure 6:
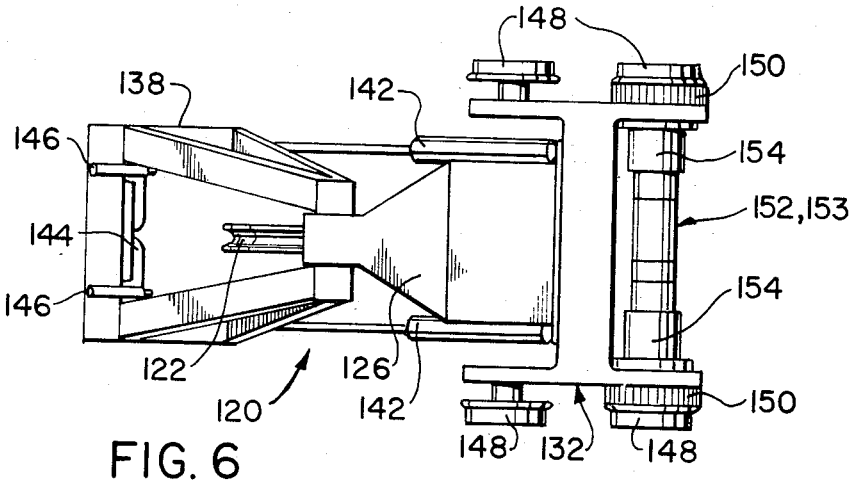
FIG. 6 is a view along FIG. VI—VI of FIG. 5.
Figure 7:
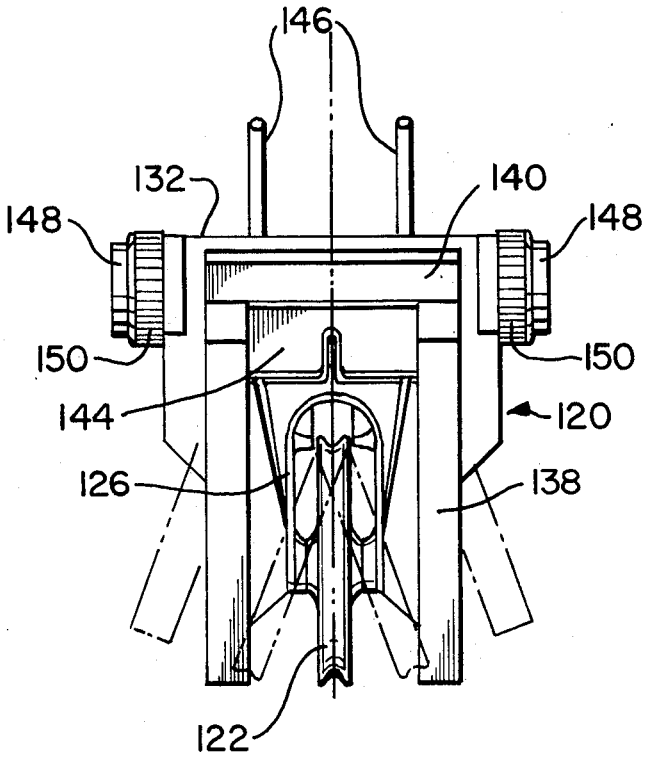
FIG. 7 is a view along line VII—VII of FIG. 5.

The saddle assembly 120 is illustrated most particularly in FIGS. 5, 6, and 7 while its operation is illustrated most clearly in FIGS. 1, 2 and 3. Referring to these drawings, the assembly 120 is underslung to achieve a low boom profile and to allow a more efficient arrangement of the boom strength members. With the underslung assembly, boom outriggers and stiffeners as used in some of the prior art are no longer necessary.

The saddle assembly has an outboard towing sheave 122 mounted on a sheave shaft 124 turning in sealed, rolling-element bearings (not shown) mounted on a hood 126. The hood extends over the top and sides of the sheave 122 to prevent the cable 170 from jumping out of the sheave groove. The hood rotates on sealed rolling-element bearings 128 mounted on a large throated annular projection 130 of a trolley 132. This will allow frictionless fairleading under cable side loads. A locking bar 134 driven by an hydraulic cylinder 136 may be used to lock out all fairleading during launch and recovering operations and while the body is stowed.

An open saddle 138 is mounted pivotably on the sheave shaft 124. The saddle is lined with a cushioning material to protect the towed body 160 during capture. Two hydraulic saddle tilt cylinders 142 hold the saddle level during launch and recovery and tilt the saddle sharply upward during towing as shown in FIGS. 3 and 5–7. The rear cross member 140 of the saddle is ballasted if necessary to raise the saddle centre of gravity in the raised or towing position so that the overall centre of gravity of all parts moving during fairleading lies approximately on the centre of the annular trolley projection 130. This allows substantially balanced, frictionless fairleading, unaffected by the weight of the moving parts except for inertia effects.

The saddle assembly carries a towstaff capture device 144 for capturing a towstaff carried on the towed body 160. The capture device 144 is in the form of a fork that is forced around the towstaff on body capture by two towstaff capture actuating hydraulic cylinders 146. The cylinders are also used to release the body for normal towing. The use of this device ensures that cable breakage after body capture will not result in loss of the body.

The trolley 132 of the saddle assembly is equipped with two pairs of trolley wheels 148 that run in the tracks of the boom beams 98, in engagement with the tread liners 102. The wheels of the forward set are coaxial with two gears 150 that engage the racks 106 on the beam. A hydraulic motor 152 and brake 153 drive the gear drive shafts through respective gear reducers 154.

A cable reel 112 is provided at the inboard end of the boom to transfer electrical cable and hydraulic hoses to and from the saddle assembly as the boom span is traversed by the assembly.

Typical electro-hydraulic circuits for the system are shown in FIGS. 9, 10, 11 and 12.

Figure 9:
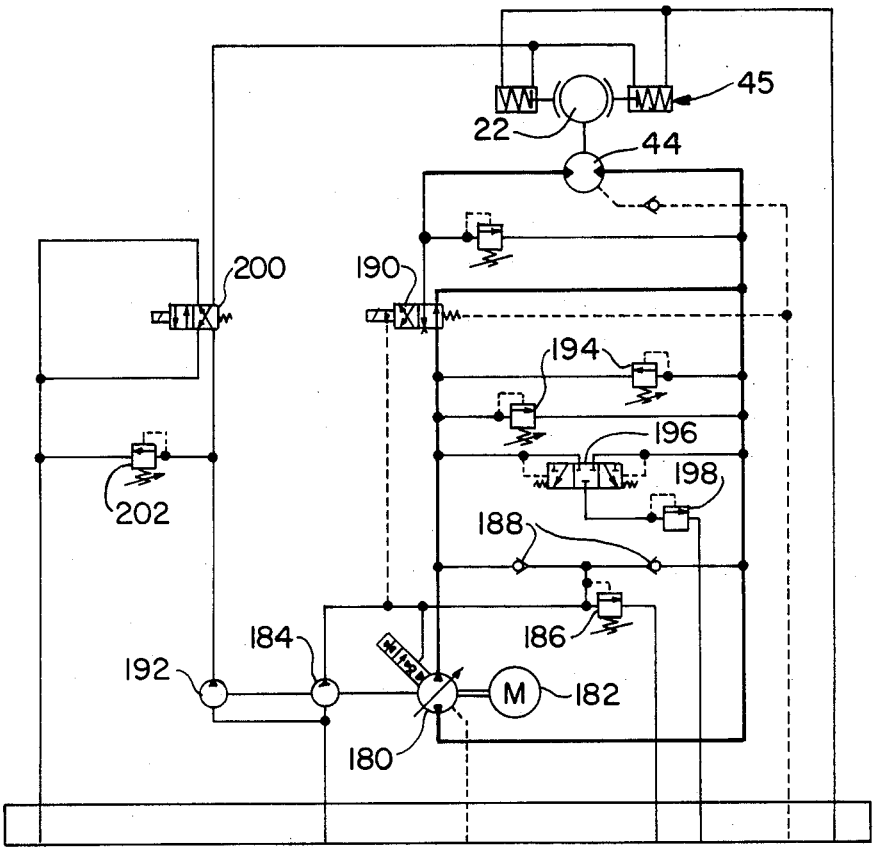
FIG. 9 is a schematic drawing of the winch drive and braking control system.

FIG. 9 depicts a winch group unit for the winch drive and braking system. It consists of a pump package and various control valves. The pump package includes a variable displacement pump 180 which supplies oil to the winch motor 44 through a closed loop. This pump features pressure compensation and electro/hydraulic displacement controls as well as an integral fixed displacement charge pump 184. The charge pump supplies oil at a pressure set by relief valve 186 through check valves 188 to the closed loop for replenishment. It also supplies oil to operate hydraulic lock directional valve 190. The pump package also includes a fixed displacement pump 192 which supplies oil to operate the winch disc brake calipers through directional valve 200 at a pressure set by relief valve 202.

The power unit is also provided with cross-over relief valves 194 for protection of the closed loop and a shuttle/relief valve arrangement 196 for maximum cooling of the closed loop oil from the low pressure side.

Figure 10:
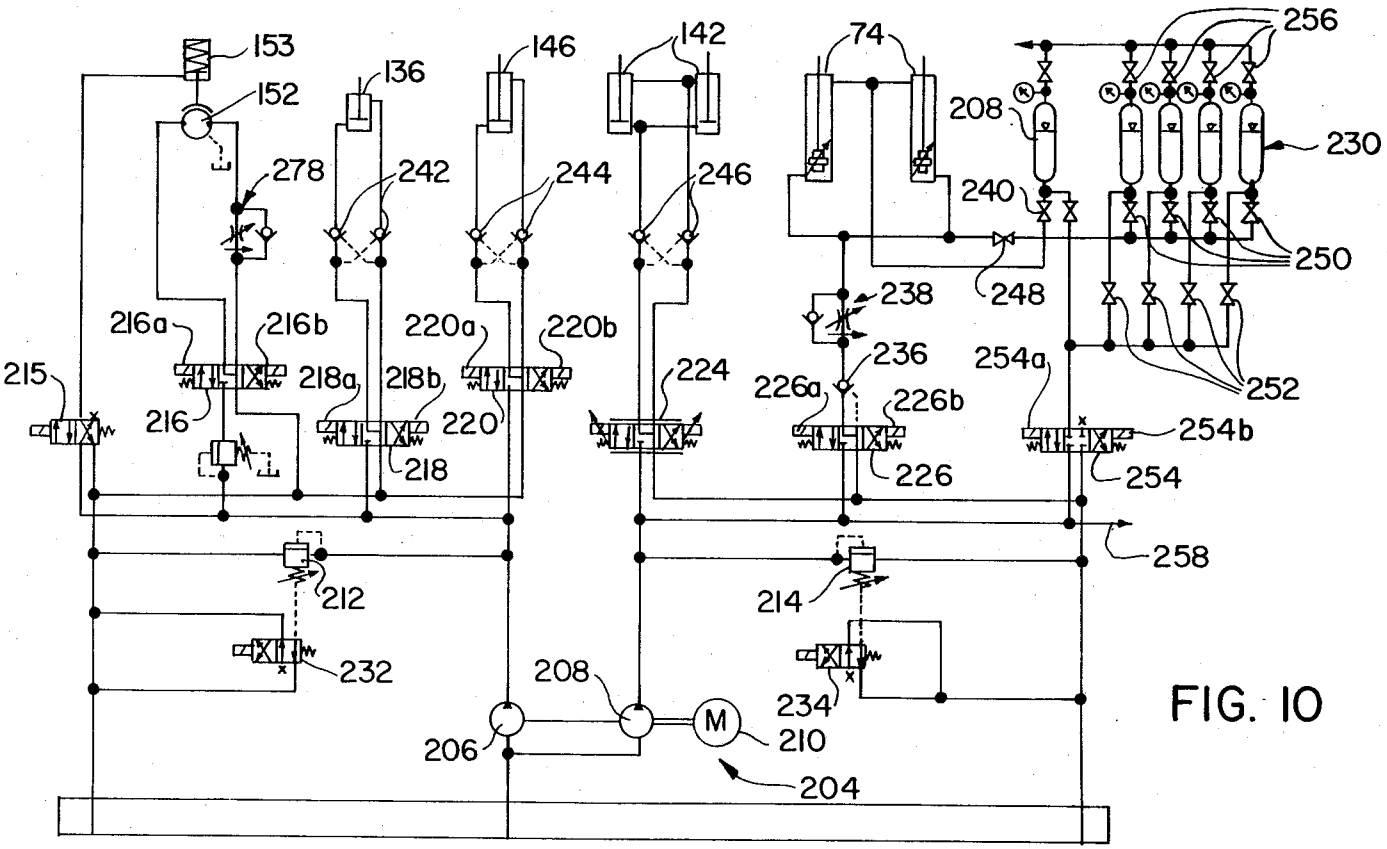
FIG. 10 is a schematic view of the control system for the boom and fairlead, sheave and saddle assembly, including the passive shock absorbing system.

FIG. 10 depicts an overboarding group power unit for the saddle drive and braking, saddle lockout and tilt, towstaff capture and passive boom cylinders. This figure also shows the passive shock absorbing circuitry.

The overboarding group power unit includes a pump package 204 that comprises two fixed displacement pumps 206 and 208 driven by a common motor 210. Pump 206 supplies oil at a pressure set by relief valve 212 to the trolley motor and brake 152 and 153, the locking bar actuator 136 and the towstaff capture actuator 146. Pump 208 supplies oil at a pressure set by relief valve 214 to the saddle tilt cylinders 142 and passive boom cylinders 74. It also supplies oil to the accumulators 228 and 230 of the passive shock absorbing system.

Figure 11:
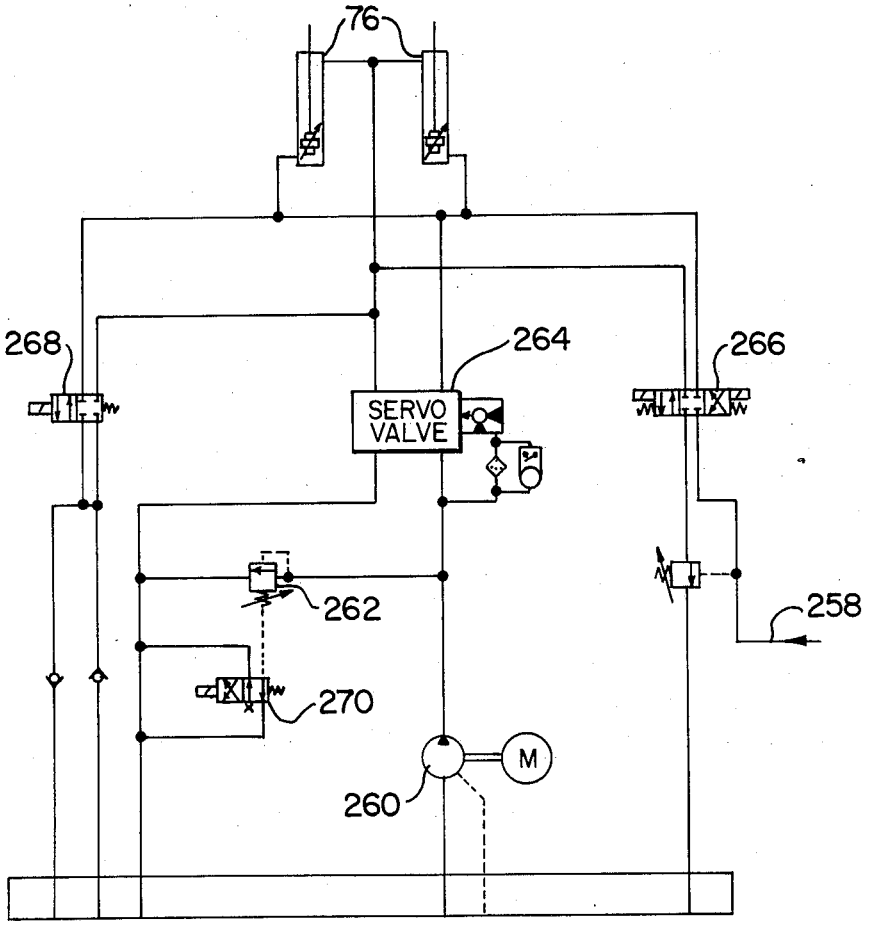
FIG. 11 is a schematic view of an active shock absorbing system.
Figure 12:
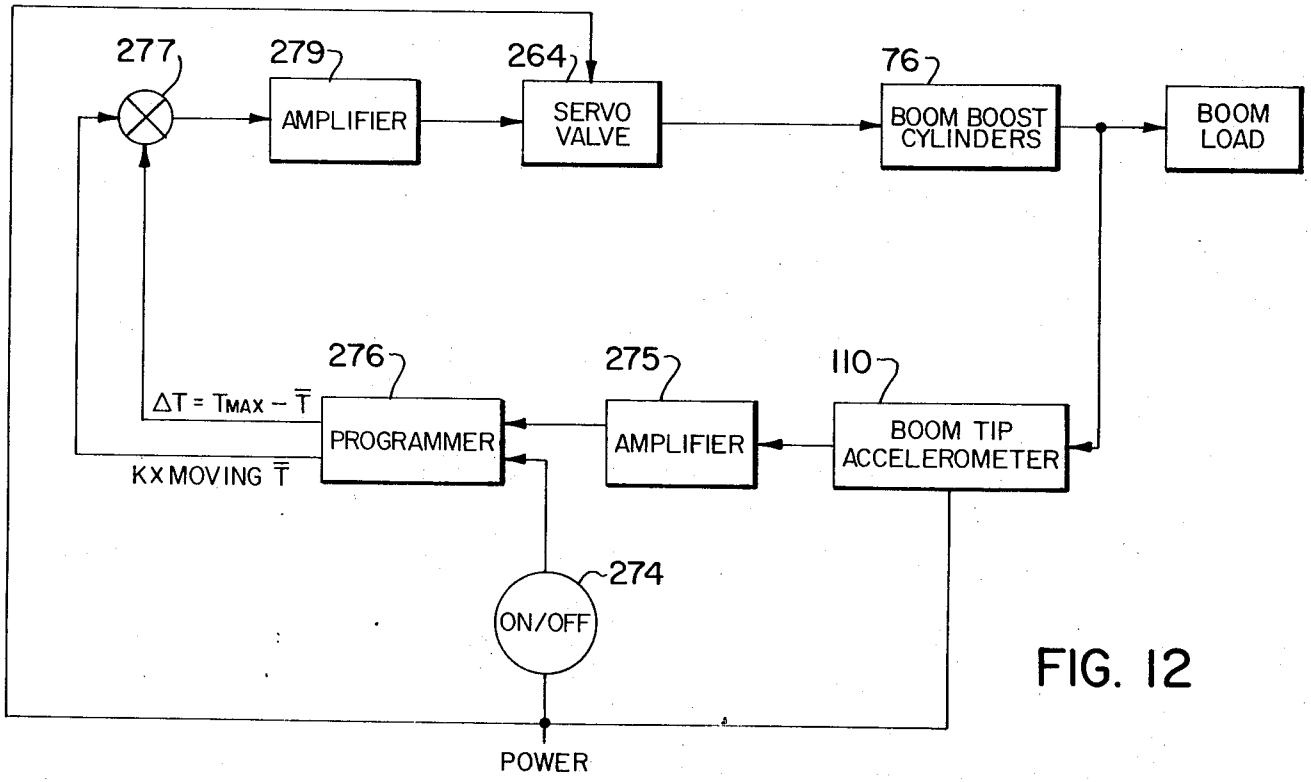
FIG. 12 is a block diagram of a closed loop servo control system for use in the active shock absorbing system.

FIG. 11 depicts an active shock absorbing power unit for the active shock absorbing system. This optional unit is wedded to a closed loop feedback system as shown in FIG. 12. The active shock absorbing power unit comprises a fixed displacement pump 260 that supplies oil at a pressure set by relief valve 262 to the active boom cylinders 76 via servo valve 264. The cylinders 76 also receive oil from the power unit of FIG. 10 via line 258 and directional valve 266. This is for positioning the cylinders 76 together with the passive boom cylinders 74 at a mean towing position. Where the active shock absorbing system is not in use, the cylinders 76 may be controlled by flow from the passive system via line 258 and valve 266. The active system may be disengaged by isolating the power unit with the valve 266 and venting the actuators 76 through valve 268.

The mode of operation is described below in the sequence of a normal launch, tow and recovery cycle. It covers the start-up, launch, pay-out, passive shock absorbing engagement and disengagement, active shock absorbing engagement and disengagement, haul-in, recovery and shut down.

On start-up, the electric motor 182 (FIG. 9) of the winch group power unit is energised and drives the pumps 180, 184 and 192. The variable displacement pump 180 is set at zero displacement. The fixed displacement pump 184 delivers oil to both sides of the closed loop through check valves 188. There is no oil flow as such in the closed loop except a small amount from pump 184 to compensate for leakage in pump 180 and motor 44. The majority of oil from pump 184 returns to the reservoir through relief valve 186. Oil from fixed displacement pump 192 is vented back to the reservoir through de-energised directional valve 200. Hydraulic lock valve 190 is de-energised at this time but still provides a dual function. Firstly the circuitry is designed so that the displacement controls of pump 180 can be operated in this mode and oil from the pump can be circulated around the closed loop in either direction by-passing winch motor 44 entirely. This feature provides a means of heating the oil in the closed loop and system and minimizing thermal shock on the winch motor 44. A second reason for valve 190 is that adjustment of the null stroke of pump 180 can be made without pressurising or moving the winch.

The electric motor 210 of the overboarding group power unit shown in FIG. 10 is also energised and drives the pump package 204. The oil from the fixed displacement pump 206 is returned to the reservoir through relief valve 232 which is vented by de-energised directional valve 232. Similarly oil from fixed displacement pump 208 is returned to the reservoir through relief valve 214, which is vented by de-energised directional valve 234. All of the other directional valves on this unit are de-energised at this time.

The active shock absorbing power unit (FIG. 11) is shut down and is only operated prior to actual engagement of the active system.

The towed body is at this time in its stowed position as shown in FIG. 2. The body is seated on a deck-mounted cradle 16 located in the well 12, and held down by the saddle assembly 120.

To launch the towed body, the pressure compensator of pump 180 is given a command to drive the pump in the haul-in direction and to maintain constant pressure. At the same time valve 200 is energised thereby supplying oil from pump 192 at a pressure set by relief valve 202 to release the winch brakes 45. Valve 190 is also energised and the closed loop is now connected to the motor 44, causing the winch to haul in.

This causes the towed body 160 to be brought snugly into the saddle 138 by the tow cable 170 which is maintained at a constant tension as set by the pressure compensator of pump 180.

Valves 232 and 234 of the overboarding group power unit are then energised thereby closing the vent ports of relief valves 212 and 214 and providing pressurised oil to their respective circuits. Actuator **226*a* of valve 226 is now energised and oil flows to the head ends of cylinders 74 through pilot check valve 236 and the check valve section of flow control valve 238. The boom 70 is then raised just sufficiently for the towed body to clear its cradle 16 at which time actuator 226*a*** is de-energised.

The boom is now locked in this partially raised attitude by pilot check valve 236. Oil displaced from the rod ends of cylinders 74 is directed to low pressure accumulator 228 through a normally open ball valve 240.

At this time valve 215 and actuator **216*b* of valve 216 are energised which causes the saddle brake 153 to release and the motor 152 to drive the saddle assembly 120 out toward the boom tip. During this translation the winch maintains constant cable tension and pays out cable to accommodate the outward movement of the saddle assembly. This is achieved by pump 180 going "over-centre" so that the pump reverts to a motor and the motor 44** to a pump, while maintaining high pressure in the haul-in side of the closed loop and holding the body firmly in the saddle.

When the saddle reaches the end of the boom 70 valve 215 and actuator **216*b* of valve 216 are de-energised stopping the motor 152 and applying brake 153. Valve 232 is also de-energised, thereby venting the oil flow from pump 206 to the reservoir through valve 212. The boom is then lowered in a controlled descent to its stops 18 (FIG. 3) by energising valve 234 and actuator 226*b* of valve 226 so that the oil from the head ends of cylinders 70 is returned to the reservoir via the flow control section of valve 238 and pressure opened pilot check valve 236. During this lowering the saddle and body are maintained in an horizontal attitude by the saddle tilt cylinders 142. Oil is directed to these cylinders through proportional valve 224 which is itself controlled by a displacement control mounted between the saddle and boom structures. When the boom reaches the lower stops 18, valve 234 and actuator 226*b*** are de-energised.

The body is allowed to flood and then valve 232 and actuator **218*b* are energised. This causes the saddle locking bar cylinder 136 to retract fully allowing the saddle assembly to swivel. Actuator 218*b* is de-energised but the locking bar cylinder 136 is maintained retracted by pilot check valves 242 which block the flow of oil. Actuator 220b is now energised so that the towstaff capture cylinder 146 disengages. Actuator 220b and valve 232 are then de-energised. The towstaff capture cylinder 146 is maintained retracted by pilot check valves 244** which block the flow of oil.

At this point the command signal to the pressure compensator of pump 180 is removed and valves 190 and 200 are de-energised. This causes the winch brakes 45 to apply so that the body is captured in the saddle ready for the payout mode.

To pay out cable, the displacement control of pump 180 is given a command to drive the pump in the payout direction. At the same time valve 200 is energised so as to release the winch brakes and valve 190 is energised connecting pump 180 to motor 44. Cable is now payed out at a controlled rate dependent on the displacement rate of pump 180. At the required depth the displacement command to pump 180 is removed and valves 190 and 200 are automatically de-energised. Pump 180 goes to zero displacement, brakes 45 apply and the hydraulic lock on the high pressure side of the motor is active.

The boom is now raised by energising valve 234 and actuator 226a of valve 226. Oil is directed to the head ends of cylinders 74 from pump 208 until the boom reaches a mean towing position at which point valves 234 and 226 are de-energised. The boom is locked in this position by pilot check valve 236 and is ready for engagement of the shock absorbing system(s). This mean towing position of the boom is approximately horizontal.

When the boom is being raised, proportional valve 224 is energised so that oil from pump 208 is directed to cylinders 142 to move the saddle to a fully tilted position for towing operations as shown in FIG. 5. In this position valve 224 is de-energised and the saddle tilt cylinders 142 remain fully extended by pilot check valves 246 which block the flow of oil.

The passive shock absorbing system is a gas/oil "spring" arrangement utilizing a number of bladder-type accumulators 230 connected to the head ends of the boom cylinders 74 through normally closed control valves 248 and 250.

Prior to engagement of the system the high pressure accumulators 230 must be properly precharged to correct pressures. Firstly valves 252 are fully opened and actuator 254b of a valve 254 is energised so as to empty the accumulators completely of oil. Valves 252 are then closed and actuator 254b de-energised. Gas valves 256 are opened to allow build-up of the proper precharge and are then closed. Valve 234 and actuator 254b are energised and valves 252 opened. Oil from pump 208 is directed into the accumulators 230 until there is a near pressure balance with the oil pressure prevailing in the head ends of cylinders 74 caused by the towing loads. Valve 234 and actuator 254a of valve 254 are then de-energised and valves 252 closed. The system is now ready for engagement.

Valves 250 are opened initially so that the pressures balance in all high pressure accumulators. Valve 248 is then opened carefully when ship's motion is "steady" thereby connecting the accumulators to the boom cylinders. Thereafter oil will flow between the accumulators and the cylinders in either direction and at varying rates in response to the transient cable loads. Valve 248 is a controllable valve that can be used to throttle the oil flow to accommodate varying sea states.

The low pressure accumulator 228 is always connected to the rod ends of the boom cylinders 74. This accumulator is precharged in the same way as the high pressure accumulators 230 with the exception that the precharge pressures are much lower and such that the total oil volume from the boom cylinder rod ends can be accommodated with the minimum of back pressure on the passive shock absorbing system. With the passive shock absorbing system engaged the boom will bob around a mean towing position. With changing conditions however, such as change of cable scope, ship's speed and course, the boom excursions will increase. To this end limits of boom movement are set so that oil can be either pumped into or bled from the system by energising actuators 254a and 254b respectively. This action will prevent the boom from going too low or too high and can also be used for small adjustment of boom position.

Disengagement of the passive shock absorbing system is achieved by closing valve 248 when the ship's motion is "steady", thereby disconnecting the cylinders 74 from the high pressure accumulators 230. If desired valves 250 can also be closed.

The active shock absorbing system can be looked upon as a power-assist and is intended to be used with the passive system. To engage the active system, the passive system is engaged and the closed loop feedback servo system switch 274 (FIG. 12) is turned on. The boom will now bob in the shock absorbing mode, not merely passively in response to fluctuating cable tensions as reflected in the varying pressures imposed on accumulators 230, but also actively as forced upon slave cylinders 76 by servo valve 264. This valve acts in response to error signal commands from the boom tip accelerometer 110 which are an indirect function of the difference between actual tension variations and desired maximum tension variations. The accelerometer 110 responds to boom tip motion and continuously sends a signal of the movement through amplifiers 275 to the programmer 276. The programmer generates two signals, $\Delta T$ representing the difference between maximum tension $T_{max}$ and mean tension $\overline{T}$ and Rx moving T, representing desired maximum tension variations. These signals are combined at 277 to produce an error signal. The error signal is amplified by amplifier 279 and sent to the servo valve 264 as a control signal.

The servo valve 262 then directs flow from pump 260 either to the head or rod ends of slave cylinders 76, depending on whether feedback shows that maximum tension $T_{max}$ must be reduced or minimum tension $T_{min}$ boosted. The aim is to maintain the boom tip at a constant distance from the centre of the earth as is possible. The active shock absorbing system is automatically disengaged from the passive system when switch 274 is turned off.

When the active system is not engaged movement of the slave cylinders 76 is controlled by oil flow from pump 208 via directional valve 266 so that they work in concert with the passive boom cylinders 74. If the active system becomes unoperative the slave cylinders 76 are vented through valve 268 allowing them to move with the minimum of resistance. Oil from pump 260 is returned to the reservoir through relief valve 262, which is vented by deenergized directional valve 270. With the passive and active shock absorbing systems engaged the system is still capable of paying out or hauling in cable.

To haul in the towed body, the shock absorbing systems are disengaged and the displacement control of pump 180 is given a command to drive the pump in the haul-in direction. At the same time valve 200 is energised so as to release the winch brakes 45 and valve 190 is energised to connect pump 180 to motor 44. Cable 170 is now hauled in at a controlled rate dependant on the displacement of pump 180.

At a certain body depth haul-in of cable is stopped and the boom is lowered to the recovery position by energising actuator **226*b* of valve 226. Oil is metered from the head ends of cylinders 74 through flow control valve 238. It then passes through pressure opened pilot check valve 236 and valve 226 to reservoir tank. At the recovery position actuator 226*b* is denergised. At the same time proportional valve 224 receives a command from the displacement control mounted between the saddle and boom structure to bring the saddle to a horizontal attitude. Oil from pump 208 flows to the saddle tilt cylinders 142** to achieve this.

The cable is then hauled in until the towed body 160 is captured hard in the saddle. With the winch still in the haul-in mode valve 232 and actuator **220*a* of valve 220 are energised causing the towstaff capture cylinder 146 to extend and engage the towstaff capture device with the tow staff. Actuator 220*a* is de-energised, but cylinder 146 is retained in its extended position by pilot check valves 244 which block the flow of oil. Actuator 218*a* of valve 218 is then energised causing the saddle locking bar cylinder 136 to extend and engage the locking bar. Valve 232 and actuator 218*a* are de-energised leaving cylinder 136 retained in its extended position by pilot check valves 242** which block the flow of oil.

At this point the displacement signal to pump 180 is removed and the pump goes to zero displacement. At the same time valves 200 and 190 are de-energised thereby capturing the body in the saddle with the winch brakes 45 and hydraulic lock. The system is now ready for recovery.

For recovery, the pressure compensator of pump 180 is given a command to drive the pump in the haul-in direction and to maintain constant pressure. At the same time valve 200 is energised releasing the winch brakes 45. Valve 190 is also energised thereby connecting pump 180 to the winch motor 44.

Valves 234 and actuator **226*a* are energised causing oil from pump 208 to flow into the head ends of the boom cylinders 74, and causing the boom to rise. At a certain angle these valves are de-energised causing the boom to stop. Valves 232, 215 and actuator 216*a* are now energised causing oil from pump 206 to release the saddle brake 153 and drive the motor 152, causing the saddle assembly to move inboard. Oil from motor 152 is metered out by flow control valve 278. When the towed body 160 is above its cradle 16, valves 232, 215 and actuator 216*a* are de-energised thereby stopping motor 152 and applying the brake 153**.

Valve 234 and actuator **226*a* of valve 226 are now energised; oil from the head ends of the boom cyliders 74 is metered out by flow control valve 238 causing the boom to lower until the towed body sits in its cradle. At this point the valves are de-energised. In addition the command signal to the pressure compensator of pump 180 is removed and valves 190 and 200** are de-energised.

For shutdown electric motors 182 and 210 are simply stopped.

If the ship is in harbour, the boom may need to be fully raised so that it does not overhang the stem of the ship. To accomplish this, slack cable must be provided between the winch drum and towed body by paying out. The boom can then be raised by directing fluid to the head ends of cylinders 74 by restarting motor 210 and energising actuator **226*a* of valve 226**. The raised position of the boom is shown in broken line in FIG. 2.

In operation of the system, the run of cable between the inboard sheave 78 and the winch drum 22 will be subject to some relatively minor torsional deflection during boom bobbing. On the other hand, there is no cable excursion over either the inboard or the outboard sheave during boom bobbing. This substantially eliminates this cause of cable fatigue.

We claim:

1. A variable depth sonar line handling system comprising a boom with inboard and outboard sheaves at respective inboard and outboard ends thereof, an inboard winch with a cable winding drum, and a cable running over the sheaves from the cable winding drum of the winch to a towed body, the system being characterized by:

mounting means mounting the winch for movement relative to the boom, in the direction of the axis of the drum, said mounting means including a winch base, tracks parallel to the drum axis and track engaging wheels on the winch base; and drive means for simultaneously rotating the drum and moving the winch axially so as to reel in and pay out the cable at a substantially constant fleet angle between the cable and the axis of the drum, said drive means comprising stationary lead screws parallel to the drum axis, nuts mounted rotatably on the winch base and engaging the lead screws, and means engaging the drum and the nuts for rotating the nuts in response to rotation of the drum about the drum axis, such as to move the winch base and the drum axially in synchronism with rotation of the drum.

2. A system according to claim 1, wherein the boom is mounted to pivot about a horizontal boom pivot axis at the inboard end of the boom and the winch is located beside the boom with the drum axis substantially perpendicular to the boom pivot axis.

3. A system according to claim 2, wherein the cable runs from the inboard sheave to the drum along the boom pivot axis.

4. A system according to claim 3, wherein the boom is mounted pivotably on a boom support with at least one hollow shaft, and the cable passes from the inboard sheave to the drum through the hollow shaft.

5. A system according to claim 1, wherein the inboard sheave is mounted on the boom by a tension link.

6. A system according to claim 5, including a strain gauge mounted on the tension link and means for monitoring the output of the strain gauge as a measure of cable tension.

7. A system according to claim 1, including boom bobbing means comprising a passive shock absorbing means exerting a substantially constant force on the boom, urging the boom to pivot upwardly and permitting downward pivotting of the boom against the substantially constant force to maintain a substantially constant tension in the cable.

8. A system according to claim 7, wherein the boom bobbing means further includes an active shock absorbing means including an accelerometer mounted on the boom remote from its pivot axis, means responsive to signals from the accelerometer for computing the difference between actual variations in tension on the cable between the outboard sheave and the towed body and desired maximum variations in tension on the cable between the outboard sheave and the towed body, and for generating a boost signal representative of the difference and servo means responsive to the boost signal to adjust the position of the boom so as to reduce cable tension variations.

9. A system according to claim 1, including a trolley carrying the outboard sheave, the trolley being mounted on the boom for movement theralong, means for driving the trolley along the boom between an inboard stowed position and an outboard towing position.

10. A system according to claim 9, including a saddle carried by the trolley for engaging the towed body.

11. A system according to claim 10, including means for pivoting the saddle from a body engaging position below the outboard sheave to a fairleading position horizontally outboard of the outboard sheave.

12. A system according to claim 11, including a fairlead hood over the outboard sheave and fairlead bearing means mounting the fairlead hood, the outboard sheave and the saddle for pivotal movement with respect to the trolley about an axis substantially parallel to the boom.

13. A system according to claim 12, including fairleading lockout means for selectively preventing pivoting movement of the fairlead hood, outboard sheave and saddle on the fairlead bearing means.

* * * * *